US007614723B2

(12) United States Patent
Hatayama

(10) Patent No.: US 7,614,723 B2
(45) Date of Patent: Nov. 10, 2009

(54) PRINTING SYSTEM, CONTROLLER FOR PRINTING APPARATUS, METHOD OF EXECUTING PRINTING PROCESS, AND PROGRAM FOR FLUSHING EJECTION

(75) Inventor: Fumihiro Hatayama, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 409 days.

(21) Appl. No.: 11/472,337

(22) Filed: Jun. 22, 2006

(65) Prior Publication Data

US 2006/0290739 A1 Dec. 28, 2006

(30) Foreign Application Priority Data

Jun. 23, 2005 (JP) ..... 2005-183191

(51) Int. Cl.
*B41J 2/165* (2006.01)

(52) U.S. Cl. ..... 347/35

(58) Field of Classification Search ..... 347/35, 347/24, 23, 19; 358/1.8
See application file for complete search history.

(56) References Cited

U.S. PATENT DOCUMENTS 5,659,342 A * 8/1997 Lund et al. ..... 347/35
5,903,288 A * 5/1999 Yamaguchi ..... 347/24
6,166,828 A * 12/2000 Yamada et al. ..... 358/1.8
6,779,867 B2 * 8/2004 Shimizu et al. ..... 347/23
7,360,859 B2 * 4/2008 Little et al. ..... 347/19
2003/0081045 A1 * 5/2003 Shimizu et al. ..... 347/23
2005/0285894 A1 * 12/2005 Nakayama ..... 347/35

FOREIGN PATENT DOCUMENTS

JP 55-139269 10/1980
JP 9-216388 8/1997
JP 2002-225301 8/2002
JP 2003-39703 2/2003
JP 2003-127429 5/2003
JP 2005-22305 1/2005

* cited by examiner

*Primary Examiner*—Stephen D Meier
*Assistant Examiner*—Carlos A Martinez, Jr.
(74) *Attorney, Agent, or Firm*—McDermott Will & Emery LLP

(57) ABSTRACT

For a low saturation and high density region in a printed sheet identified based on rasterized data, flushing ejection is executed, with landing positions dispersed in the region. For a region being low in saturation but not high in density, an edge portion of the region is determined as landing positions. During these processes, adjustment is made to the ejection from inkjet nozzels for color components which are not to be subjected to the flushing ejection, to maintian the original hue of the region. This achieves the flushing ejection minimizing the degradation of the quality of the printed sheet. Further, in the variable printing, necessity of the flushing ejection is judged based on details to be printed on a base page. This causes the evacution of the flushing ejection whenever individual printed sheets are produced. Therefore, the print quality is held uniform during the production of different printed sheets.

16 Claims, 10 Drawing Sheets

PRINTING SYSTEM, CONTROLLER FOR PRINTING APPARATUS, METHOD OF EXECUTING PRINTING PROCESS, AND PROGRAM FOR FLUSHING EJECTION

BACKGROUND OF THE INVENTION

1. Field of the Invention

The present invention relates to a flushing process in an inkjet printing apparatus having a fixed print head.

2. Description of the Background Art

There has been a widespread proliferation of inkjet printing apparatuses (or so-called inkjet printers) of the type in which printing is done on predetermined paper by the ejection or the like of fine ink particles (referred to also as ink droplets and the like) from a plurality of nozzle tips provided in a print head and having a very small diameter. In terms of print head configurations, the inkjet printing apparatuses are classified broadly into two types: a movable-head printing apparatus which performs printing by ejecting ink droplets in succession while moving a print head responsible for printing; and a fixed-head (line-head) printing apparatus which performs printing on a line-by-line basis while feeding a printing paper sheet immediately under a fixed print head having a size large enough to cover the width of the printing paper sheet.

The inkjet printing apparatuses of either type suffer from a print defect resulting from improper ink ejection and the like if the drying of ink due to the evaporation of a solvent near nozzles, the entry of bubbles into the nozzles or the deposition of dust onto the nozzles takes place during printing.

Some of the inkjet printers are intended to eliminate the ejection defect by executing a wipe process for wiping tip portions (nozzle portions) of the print head and a suction process for sucking up an unwanted substance from the tip portions. Also known in the art is a fixed-head inkjet printer which includes an ink receiver movable in synchronism with the transport of a printing paper sheet and which is capable of ejecting unwanted ink droplets toward the ink receiver while continuing to execute a printing operation (as disclosed, for example, in Japanese Patent Application Laid-Open No. 2005-22305). However, the execution of these processes requires the inkjet printers to have mechanisms therefor. Additionally, the need to execute a different operation than a printing process results in the decrease in throughput. In the use of a fixed line head of large size, a movement operation just for executing the process for such maintenance requires considerable time, which is not efficient in cost.

To avoid such problems, an inkjet printing apparatus configured to carry out flushing (also known as idle ejection, preliminary ejection and the like) during printing is known in the art, the flushing being the process of forcibly executing an ink ejection operation independent of what is to be printed, under predetermined conditions. Such inkjet printing apparatuses are disclosed, for example, in Japanese Patent Application Laid-Open No. 2003-39703, Japanese Patent Application Laid-Open No. 2002-225301, Japanese Patent Application Laid-Open No. 2003-127429, Japanese Patent Application Laid-Open No. 55-139269 (1980), and Japanese Patent Application Laid-Open No. 9-216388 (1997).

The ink ejection operation executed by the printing apparatus during the flushing process is essentially identical with the ejection operation during the printing process. It is hence unnecessary to add a special mechanical component to the inkjet printing apparatus in order to execute the flushing process. A more important consideration is when to perform the flushing. Specifically, there arises a need to determine the position and pattern of ink ejection on a printing paper sheet so as not to interfere with what is to be originally printed. Additionally, more ink than necessary need not be ejected in ordinary cases because it is only necessary to prevent the drying of ink and the like.

Japanese Patent Application Laid-Open No. 2003-39703, Japanese Patent Application Laid-Open No. 2002-225301 and Japanese Patent Application Laid-Open No. 2003-127429 disclose the ejection of ink onto various regions (a perforated tear-off region, a binding margin region, a region between images, a region for bleeding and the like) of a printing paper sheet. Japanese Patent Application Laid-Open No. 2003-127429 also discloses a technique such that a pattern formed by the flushing is used as a mark for bleeding of a printed sheet. These disclosed techniques present a problem in that it is sometimes impossible to perform the flushing process because of the absence of the regions to be subjected to the ink ejection depending on what is to be printed. When such techniques are applied to the fixed-head inkjet printing apparatus, in particular, all of the nozzles arranged in line in the print head must stand ready to perform the flushing process at some point in time. This imposes a limit on when to eject the ink. As a result, there are cases where effective flushing is not carried out.

Japanese Patent Application Laid-Open No. 55-139269 (1980) discloses a technique in which the ink ejection by flushing is performed discretely on a printing paper sheet so that the ejected ink is inconspicuous on the printed paper sheet. The technique disclosed in Japanese Patent Application Laid-Open No. 55-139269 (1980), however, may be undesirable in the case of low-resolution printing in which the dots formed by ink ejection from the nozzles are large in size, because of conspicuity of the dots.

Japanese Patent Application Laid-Open No. 9-216388 (1997) discloses a technique employed for an inkjet printing apparatus capable of four-color printing using CMYK. In this inkjet printing apparatus, nozzles for cyan, magenta and yellow which are not in use eject ink for flushing onto a position where black ink is to be placed so that the cyan, magenta and yellow inks are concealed under the black ink, whereby the flushing is performed in an inconspicuous manner. The technique disclosed in Japanese Patent Application Laid-Open No. 9-216388 (1997), however, does not perform the idle ejection of the black ink onto the printing paper sheet.

SUMMARY OF THE INVENTION

The present invention is intended for a flushing process in an inkjet printing apparatus and, more particularly, for a flushing process in an inkjet printing apparatus having a fixed print head.

According to the present invention, a printing system comprises: a) a printing apparatus including a fixed print head having a plurality of nozzles arranged in an array in corresponding relation to each of a plurality of color components, the printing apparatus ejecting ink from the plurality of nozzles based on predetermined printing data described in raster format to perform printing on a printing sheet; and b) a controller for the printing apparatus, the controller including b-1) an acquisition element for acquiring print job data, b-2) a generation element for generating the printing data in accordance with descriptions of the print job data, b-3) a judgment element for judging whether flushing ejection from each of the plurality of nozzles is necessary or not to identify a flushing-needed nozzle among the plurality of nozzles, b-4) a flushing ejection adjustment element for determining landing positions to which the flushing-needed nozzle applies ink during the flushing ejection and for adjusting the amount of ink ejection in the landing positions to generate adjustment data having described therein information about the landing positions and the amount of ink ejection after the adjustment, and b-5) an instruction element for instructing the printing apparatus to perform printing based on the printing data and the adjustment data, the judgment element calculating the amount of ink ejection from each of the plurality of nozzles in the case of executing a printing process for the print job data in the printing apparatus, based on descriptions of the printing data, thereby to judge whether the flushing ejection from each of the plurality of nozzles is necessary or not, based on a result of the calculation, the flushing ejection adjustment element identifying a low saturation region based on the printing data to determine the low saturation region as a target for the landing positions, the low saturation region being to appear in a printed sheet when a printing process for the print job data is performed in the printing apparatus.

The flushing ejection from the flushing-needed nozzle is performed on the low saturation region of the printed sheet in which it is relatively difficult to detect a change in hue with the naked eye. This eliminates the need to ensure the ejection region for flushing separately from the print region, and prevents ink from being placed onto an originally blank region. Additionally, if a color density value in the landing positions deviates more or less, the deviation is less conspicuous. Therefore, the flushing ejection is accomplished without the substantial degradation of the print quality.

Preferably, in the printing system, the flushing ejection adjustment element identifies a high density region based on the printing data to determine the landing positions so that the landing positions are dispersed in the low saturation region when the low saturation region corresponds to the high density region, the high density region being to appear in a printed sheet when a printing process for the print job data is performed in the printing apparatus.

Thus, the flushing ejection from the flushing-needed nozzle is performed on the high density region in which it is more difficult to detect a change in hue, with the landing positions dispersed. This further suppresses the degradation of the print quality as the flushing ejection is executed.

Preferably, in the printing system, the flushing ejection adjustment element also adjusts the amount of ink ejection from some of the plurality of nozzles which are other than the flushing-needed nozzle and which have the same landing positions as the flushing-needed nozzle so that a hue in the landing positions is approximately maintained after the flushing ejection when the flushing ejection adjustment element adjusts the amount of ink ejection in the landing positions to which the flushing-needed nozzle applies ink during the flushing ejection.

Thus, when the flushing ejection is performed, the original hue in the landing positions is substantially maintained. This accomplishes the flushing ejection which suppresses the degradation of the print quality more effectively.

Preferably, in the printing system, when the print job data includes repeating unit data for causing repeated printing of the same printed details, the generation element generates data including unit printing data corresponding to the repeating unit data as the printing data. The judgment element identifies the flushing-needed nozzle based on the unit printing data. The flushing ejection adjustment element determines the landing positions to which the flushing-needed nozzle applies ink during the flushing ejection and adjusts the amount of ink ejection, based on the unit printing data.

It is hence unnecessary to make a flushing judgment on all of the printing data, to achieve higher processing efficiency. When the flushing ejection is necessary, the ejection is performed without fail while a portion corresponding to the repeating unit is being printed. This accomplishes reliable flushing.

It is therefore an object of the present invention to provide an inkjet printing apparatus having a fixed print head and capable of performing a flushing process which avoids the degradation of print quality during a printing process, and a method of processing the same.

These and other objects, features, aspects and advantages of the present invention will become more apparent from the following detailed description of the present invention when taken in conjunction with the accompanying drawings.

DESCRIPTION OF THE PREFERRED EMBODIMENTS

<System Configuration>

Figure 1:
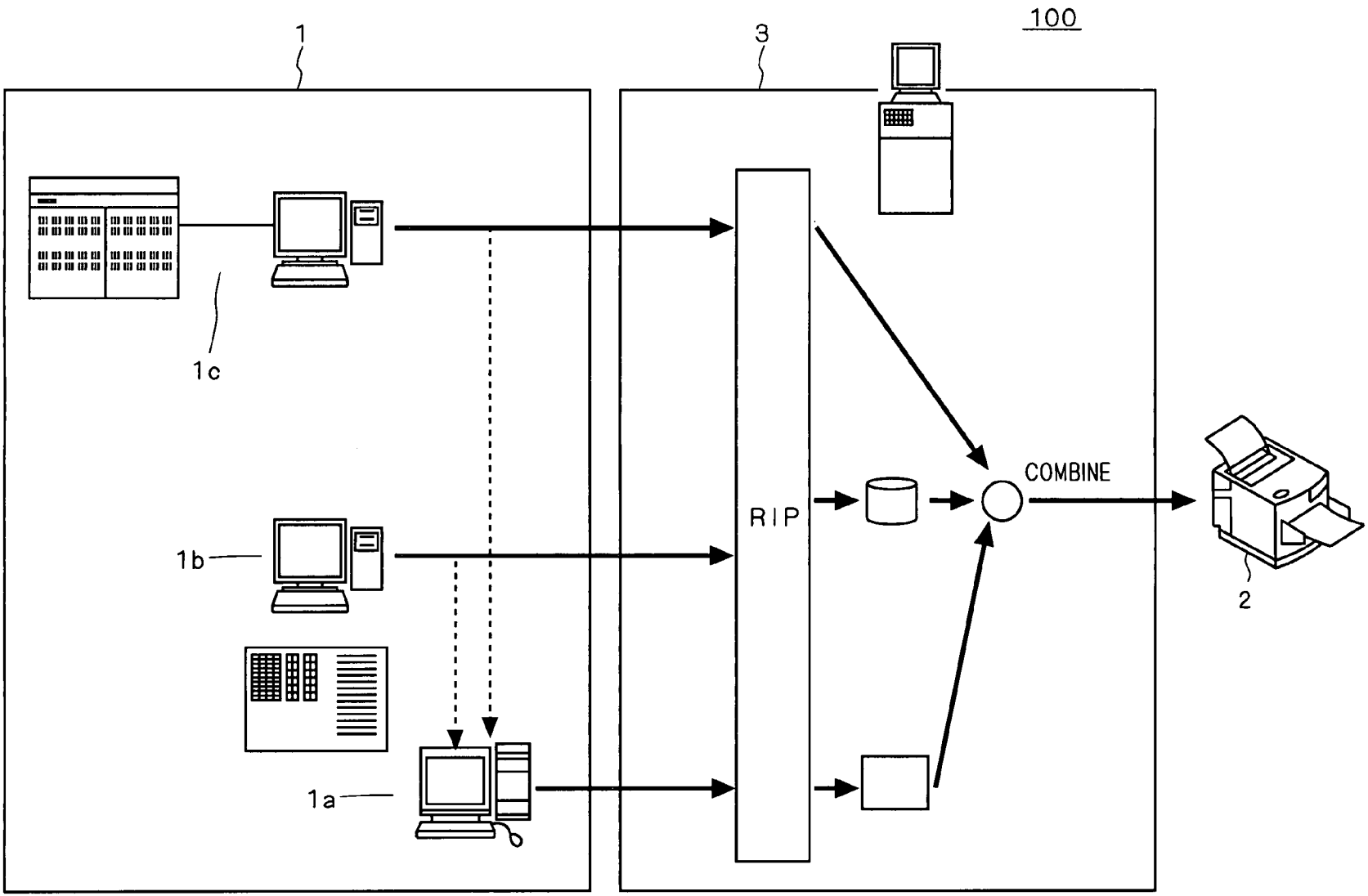
FIG. 1 schematically shows a construction of a printing system according to the present invention.

FIG. 1 schematically shows a construction of a printing system 100 according to a preferred embodiment of the present invention. The printing system 100 is a system capable of executing variable printing for producing a plurality of printed sheets containing individually different printed details while using the same base page (or form). As shown in FIG. 1, the printing system 100 includes a job creation system 1, a printing apparatus 2 for inkjet printing, and a controller 3 electrically connected to the printing apparatus 2 for controlling the operation of the printing apparatus 2. The job creation system 1 and the controller 3 are connected to each other by way of a network such as a (wired) LAN to constitute a so-called client server system. The job creation system 1 and the controller 3 may be connected to each other through a wireless communication element not shown or be capable of transferring and receiving data to and from each other through a predetermined recording medium.

<Job Creation System>

The job creation system 1 is a system for creating print job data about a printed sheet to be outputted from the printing apparatus 2. The job creation system 1 is configured to create the print job data adaptable to the above-mentioned variable printing. Specifically, the job creation system 1 includes a job creation apparatus 1*a*, a reusable data storage apparatus 1*b*, and a variable data storage apparatus 1*c*.

Figure 2:
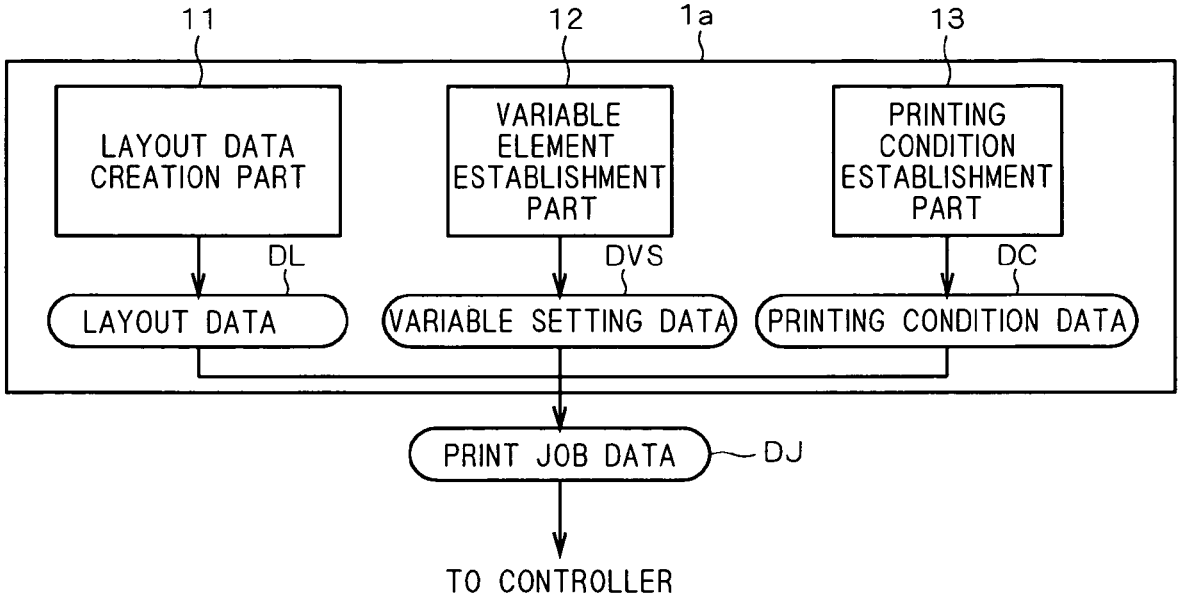
FIG. 2 is a diagram showing functional components of a job creation apparatus.

The job creation apparatus 1*a* is implemented by a so-called personal computer. FIG. 2 is a diagram showing functional components of the job creation apparatus 1*a*. A predetermined job creation program is read by the job creation apparatus 1*a* and executed by a CPU, a RAM and a ROM not shown, whereby a layout data creation part 11, a variable element establishment part 12, and a printing condition establishment part 13 are principally implemented.

The layout data creation part 11 is provided to create data (layout data DL) representing the layout of a printed sheet to be subjected to the variable printing. Specifically, the layout data creation part 11 is responsible for processes for designing a base page representing a portion common to all printed sheets, and for specifying positions in which variable portions containing printed details differing between individual printed sheets are to be placed.

The variable element establishment part 12 is responsible for the process of creating data (variable setting data DVS) for associating a layout element related to each of the above-mentioned variable portions with its position.

Under the action of the layout data creation part 11 and the variable element establishment part 12, a job creation process is achieved which includes a layout process for the base page common to all printed sheets and the process of associating layout elements (images, text and the like) in the variable portions differing between individual printed sheets with the base page.

The printing condition establishment part 13 is provided to create data (printing condition data DC) representing various conditions (resolution, sheet size, the number of sheets, and the like) to be established by the printing apparatus 2 for printing.

In the job creation apparatus 1*a*, print job data DJ is created as data including the layout data DL, the variable setting data DVS and the printing condition data DC. In this preferred embodiment, variable printing is done to produce a plurality of printed sheets, based on a single piece of print job data DJ. The print job data DJ created in the job creation apparatus 1*a* is transferred to the controller 3.

The layout process and the process of establishing the variable portions in the job creation apparatus 1*a* are performed by using a so-called GUI (Graphical User Interface).

Each of the reusable data storage apparatus 1*b* and the variable data storage apparatus 1*c* is a database server for storing information about the layout elements in the above-mentioned variable portions. The reusable data storage apparatus 1*b* is responsible for the function of storing data (or records) about a layout element to be repeatedly used (or reused) to produce certain printed sheets. The variable data storage apparatus 1*c* is responsible for the function of storing data (records) about layout elements differing between individual printed sheets.

For the printing of a credit card statement or an itemized call statement for each individual person as an example, information (variable data) for identifying each individual person and information about a past record of purchases or calls of each individual person are stored in the variable data storage apparatus 1*c*. Stored in the reusable data storage apparatus 1*b* is information (reusable data) about content and the like to be printed on only credit card statements or itemized call statements for a specific majority of individual persons satisfying a given condition, e.g. information for advertisement in accordance with sex, age, and the usage pattern of credit cards and telephones.

In other words, the variable data is data for providing inherent details to be printed to individual sheets during the variable printing based on a single piece of print job data DJ. Thus, when some records stored in the variable data storage apparatus 1*c* are defined as the variable data, each of the above-mentioned records is used only once in a series of printing steps. The reusable data, on the other hand, is data which is not common to all printed sheets but provides the same details to be printed to a plurality of sheets satisfying a certain condition (e.g., to which the variable data is common). Thus, when some records stored in the reusable data storage apparatus 1*b* are defined as the reusable data, each of the records is used at least once to produce any printed sheet, and is subsequently repeatedly used (reused) if satisfying a predetermined condition.

The job creation apparatus 1*a* creates the print job data DJ while referencing the descriptions of the data previously stored in the reusable data storage apparatus 1*b* and the variable data storage apparatus 1*c*. Alternatively, necessary data may be stored in the reusable data storage apparatus 1*b* and the variable data storage apparatus 1*c* while the print job data DJ is being created.

<Controller>

Figure 3:
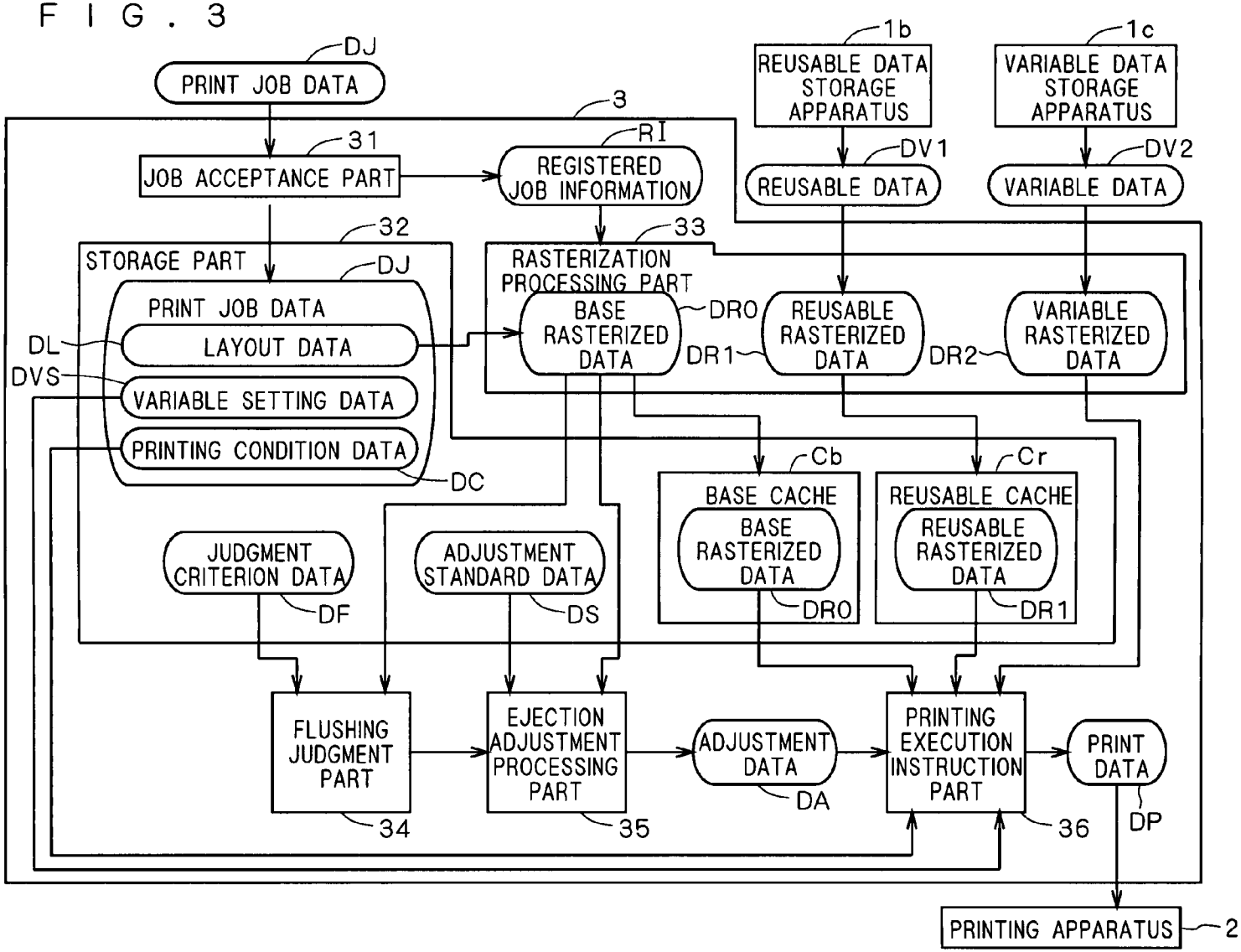
FIG. 3 is a diagram showing functional components of a controller.

The controller 3 is provided to control a printing process in the printing apparatus 2. FIG. 3 is a diagram showing functional components of the controller 3. The controller 3 is implemented by a so-called server computer. A predetermined control program is read by the controller 3 and executed by a CPU, a RAM and a ROM not shown, whereby a job acceptance part 31, a storage part 32, a rasterization processing part 33, a flushing judgment part 34, an ejection adjustment processing part 35, and a printing execution instruction part 36 are principally implemented.

The job acceptance part 31 registers the print job data DJ received from the job creation system 1 (or makes job registration) so that the print job data DJ is subjected to the printing process, and generates registered job information RI. The print job data DJ is temporarily stored in the storage part 32.

The storage part 32 is responsible for storing the print job data DJ to be subjected to the printing process, and for storing various data including judgment criterion data DF for use in a flushing judgment to be described later and adjustment standard data DS for reference during an adjustment process to be performed for flushing ejection. The storage part 32 is also configured to function as two caches: a base cache Cb and a reusable cache Cr. These caches Cb and Cr will be described later. The storage part 32 includes recording media such as a RAM, a hard disc and the like (not shown).

The rasterization processing part 33 identifies a piece of print job data DJ to be subjected to the printing process by reference to the registered job information RI to perform a rasterization process based on the descriptions of the identified piece of print job data DJ, thereby generating data in a raster format (KCMY image data) processable by the printing apparatus 2. Specifically, the rasterization processing part 33 performs the rasterization process based on the layout data DL included in the identified piece of print job data DJ to generate base rasterized data DR0 which is raster data about a base page portion. Further, the rasterization processing part 33 acquires all pieces of reusable data DV1 and all pieces of variable data DV2 about layout elements in variable portions associated with the base page portion from the reusable data storage apparatus 1*b* and the variable data storage apparatus 1*c*, respectively, based on the descriptions of the variable setting data DVS included in the identified piece of print job data DJ. Then, the rasterization processing part 33 performs the rasterization process based on the acquired reusable data DV1 and variable data DV2 to generate reusable rasterized data DR1 and variable rasterized data DR2, respectively. Known techniques are applicable to the rasterization process.

The generated base rasterized data DR0 is held in the base cache Cb. All pieces of reusable rasterized data DR1 are held in the reusable cache Cr. The base rasterized data DR0 is data used in common by all printed sheets during the variable printing based on a piece of print job data DJ. The pieces of reusable rasterized data DR1 are data repeatedly used under a predetermined condition. Therefore, holding the base rasterized data DR0 and the pieces of reusable rasterized data DR1 in the respective caches eliminates the need to perform the rasterization process each time an individual printed sheet is to be produced, thereby achieving the increase in processing efficiency.

The flushing judgment part 34 is responsible for the process of judging whether a flushing process is necessary during the printing process for a piece of print job data DJ to be subjected to the printing process or not in accordance with the judgment criterion data DF stored in the storage part 32, based on descriptions of the base rasterized data DR0. Such a process is referred to as a flushing judgment.

The ejection adjustment processing part 35 generates adjustment data DA for adjustment of the amount of ejection of ink from an objective inkjet nozzle 24 (see FIG. 6) when it is judged that a flushing process is necessary. The ejection adjustment processing part 35 specifies a landing position (also referred to as a "target region") to which ink is to be applied during flushing ejection based on the adjustment standard data DS stored in the storage part 32, determines a color density value for the flushing ejection by reference to the base rasterized data DR0, and describes information about the landing position and about the color density value as the adjustment data DA.

The flushing judgment in the flushing judgment part 34 and the generation of the adjustment data DA in the ejection adjustment processing part 35 will be described in detail later.

The printing execution instruction part 36 is responsible for the function of instructing the printing apparatus 2 to execute the printing. The printing execution instruction part 36 generates print data DP for each individual printed sheet by combining together the following data: the base rasterized data DR0 held in the base cache Cb; the reusable rasterized data DR1 held in the reusable cache Cr; the variable rasterized data DR2 corresponding to each printed sheet; the adjustment data DA generated in the ejection adjustment processing part 35; and the printing condition data DC included in the print job data DJ. The print data DP may be regarded as a data set composed of the above-mentioned data. The printing execution instruction part 36 sends the print data DP to the printing apparatus 2 to cause the printing apparatus 2 to perform the printing process for producing each printed sheet based on the print data DP.

In other words, the printing execution instruction part 36 generates a plurality of pieces of print data DP including the common base rasterized data DR0, different pieces of reusable rasterized data DR1 and different pieces of variable rasterized data DR2, in a sequential manner, to send the plurality of pieces of print data DP to the printing apparatus 2, thereby causing the printing apparatus 2 to perform the printing process. This produces a plurality of printed sheets different in printed details from each other. That is, the variable printing is accomplished. Additionally, the flushing process based on the adjustment data DA is appropriately carried out during the printing process.

<Printing Apparatus>

Figure 4:
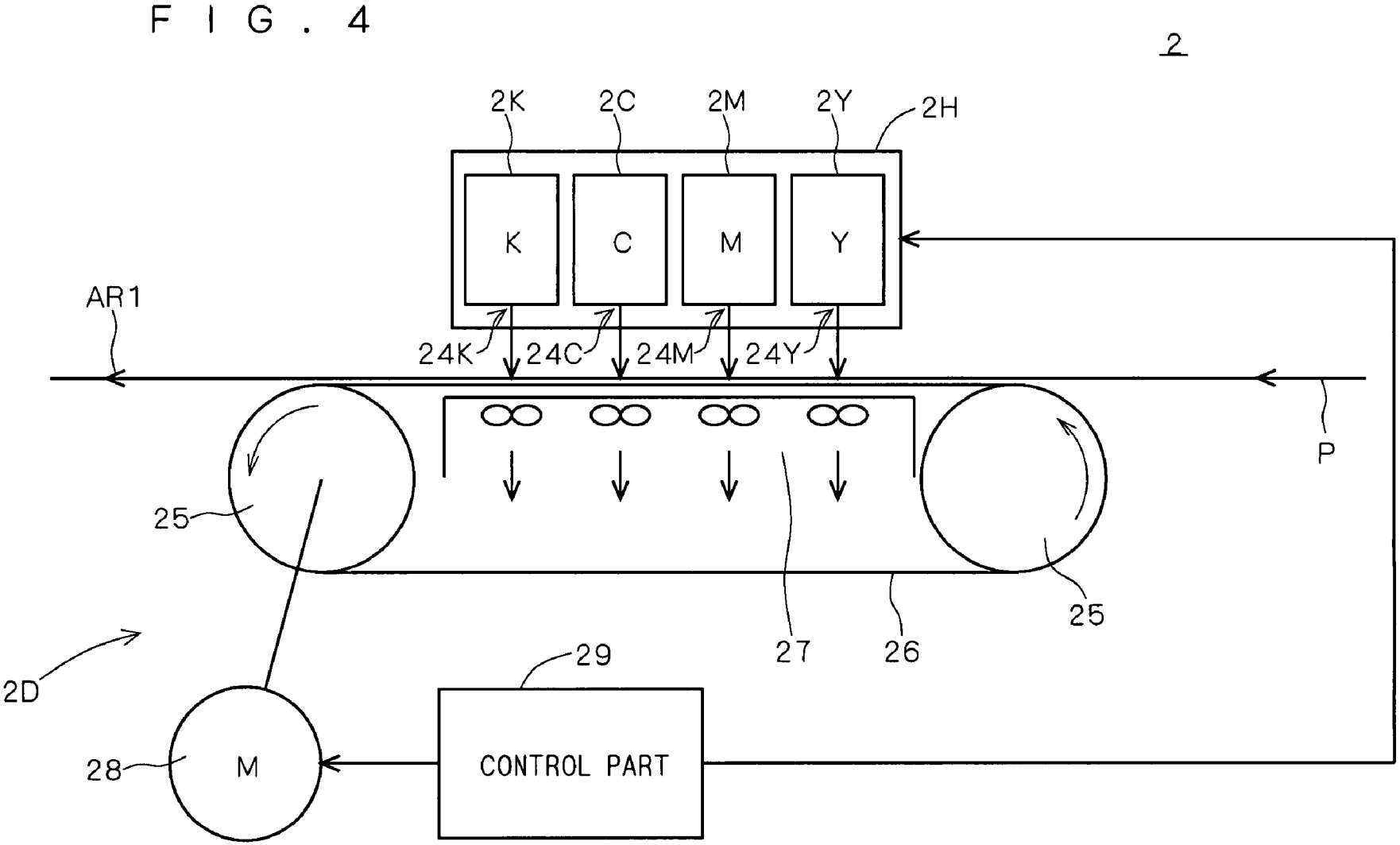
FIG. 4 is a schematic sectional view illustrating components related to a printing process in a printing apparatus.

The printing apparatus 2 performs inkjet printing based on the print data DP received from the controller 3. FIG. 4 is a schematic sectional view illustrating components related to the printing process in the printing apparatus 2. Under the control of a control part 29 based on descriptions of the print data DP given from the controller 3, the printing apparatus 2 appropriately ejects ink from a fixed inkjet head 2H toward a printing sheet p while causing a transport mechanism 2D to feed the printing sheet p in a direction indicated by the arrow AR1 under the fixed inkjet head 2H, thereby forming a printed image.

Figure 5:
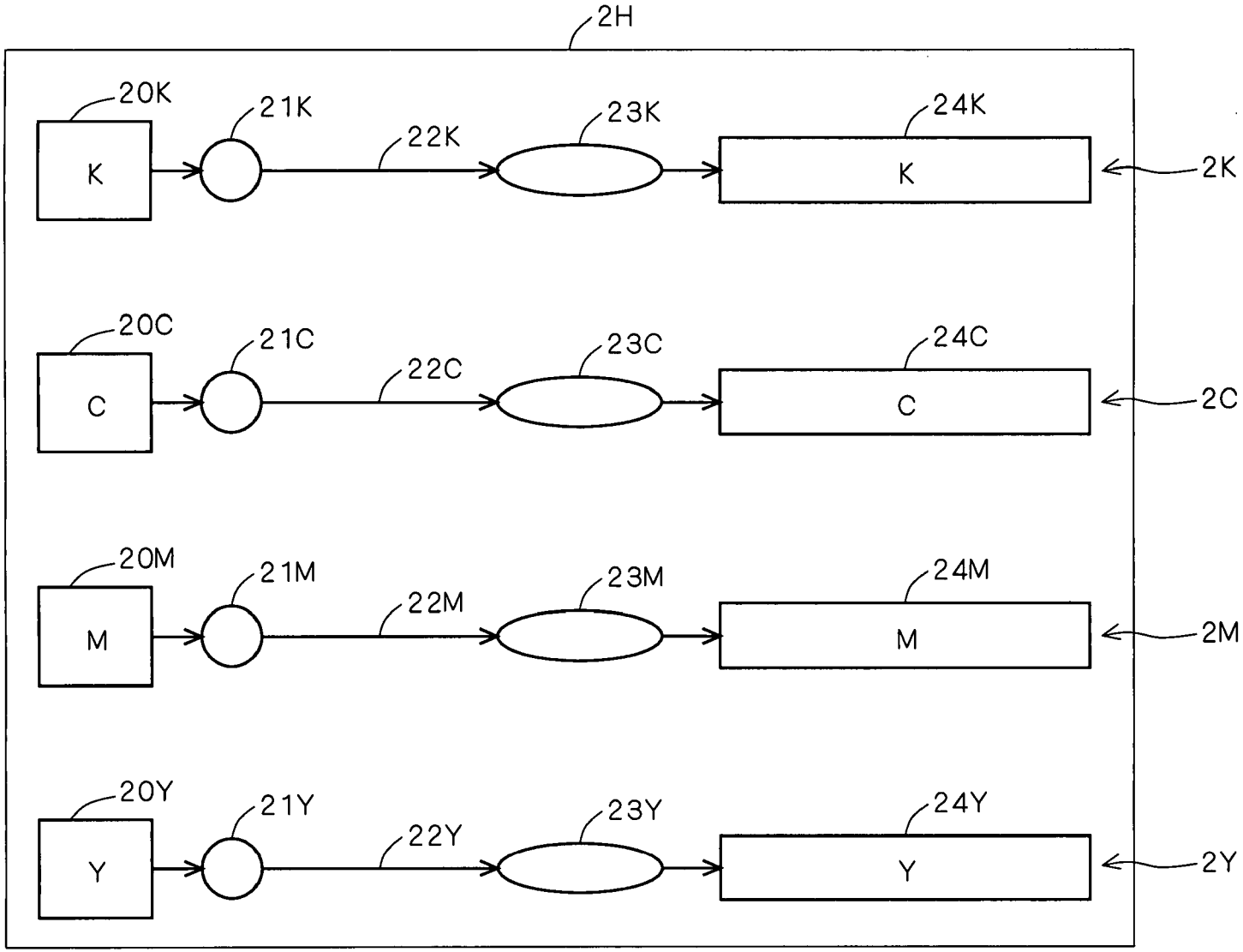
FIG. 5 schematically illustrates components related to ink supply in the printing apparatus.
Figure 6:
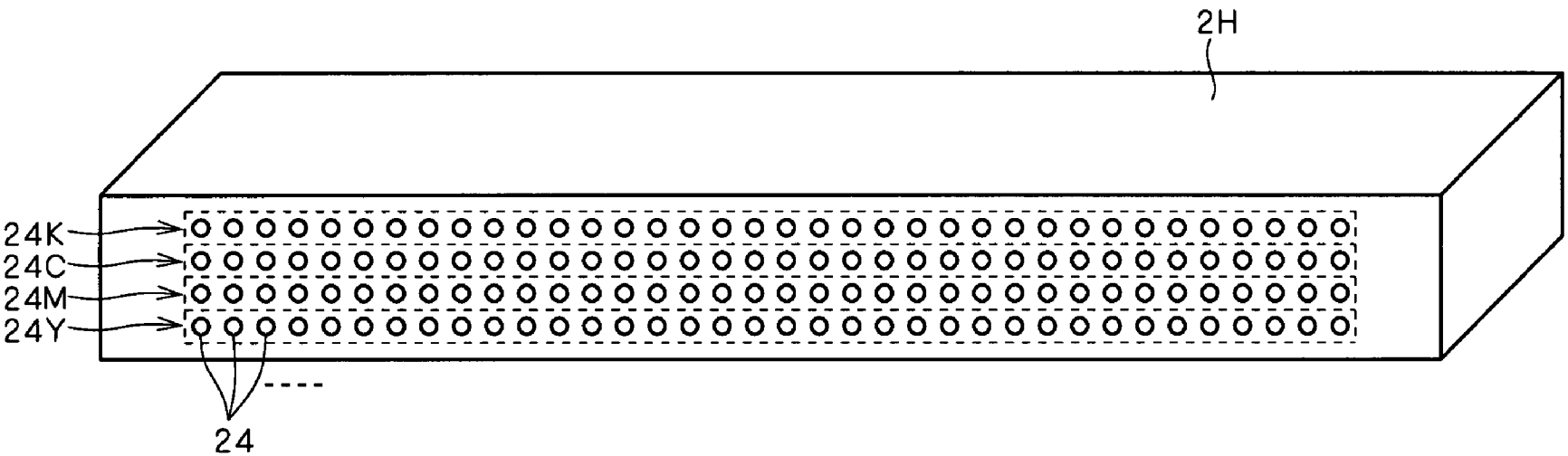
FIG. 6 is a view schematically illustrating an external structure of an inkjet head as seen from below.

In this preferred embodiment, the inkjet head 2H is constructed to be able to independently supply inks of the following four colors: K (black); C (cyan); M (magenta); and Y (yellow). The inkjet head 2H contains four ejection parts 2K, 2C, 2M and 2Y corresponding to the respective color components. FIG. 5 schematically illustrates components related to ink supply in the printing apparatus 2. FIG. 6 is a view schematically illustrating an external structure of the inkjet head 2H as seen from below.

In the printing apparatus 2, the inks of the KCMY color components stored in respective ink tanks 20K, 20C, 20M and 20Y are supplied through respective flow passages 22K, 22C, 22M and 22Y to respective sub-tanks 23K, 23C, 23M and 23Y by the action of respective pumps 21K, 21C, 21M and 21Y provided in corresponding relation to the ink tanks. The sub-tanks 23K, 23C, 23M and 23Y are connected to nozzle groups 24K, 23C, 23M and 24Y, respectively, responsible for the ejection of the inks toward the printing sheet p.

The sub-tanks 23K, 23C, 23M and 23Y are members expandable depending on the pressure of the inks supplied from the pumps 21K, 21C, 21M and 21Y, for example laminated tubes. In this preferred embodiment, each of the sub-tanks 23K, 23C, 23M and 23Y is configured to temporarily store a fixed amount of ink therein. This achieves the stable supply of the inks to the nozzle groups 24K, 24C, 24M and 24Y.

Each of the nozzle groups 24K, 24C, 24M and 24Y is positioned in opposed relation to the printing sheet p being fed, and is composed of a multiplicity of inkjet nozzles 24 (inkjet elements) arranged in a horizontal direction as viewed in FIG. 6 (or in a direction perpendicular to the plane of FIG. 4). In this preferred embodiment, the amounts of ink ejected from the respective inkjet nozzles 24 are independently controlled by the control part 29. Specifically, the ink ejected from each of the inkjet nozzles 24 produces a dot corresponding to one pixel of a printed image and having a predetermined color density. The number of inkjet nozzles 24 included in each nozzle group is determined in accordance with a resolution in the direction perpendicular to the plane of FIG. 4 and a printable region. The inkjet head 2H shown in FIG. 6 is only illustrative. The configuration of the inkjet nozzles 24, including the number and arrangement of inkjet nozzles 24, is not limited to that shown in FIG. 6. In reality, the inkjet nozzles 24 are arranged in a predetermined configuration so as to achieve a printing resolution ranging from hundreds of dots per inch to thousands of dots per inch. A known inkjet printing apparatus having such a print head may be used as the printing apparatus 2 according to this preferred embodiment.

The transport mechanism 2D includes a transport belt 26 tightly looped around a pair of transport rollers 25. The transport mechanism 2D includes a suction holding part 27. Under the control of the control part 29, the suction holding part 27 holds the printing sheet p under suction, and a motor 28 drives the transport rollers 25 to rotate, whereby the transport belt 26 transports the printing sheet p.

In the printing apparatus 2, the control part 29 controls the operations of the respective components based on the print data DP, whereby ink is ejected from a nozzle group for each color component in a timed relationship with the passage of the printing sheet p, the amount of ejection of the ink being determined in accordance with the color density value described in the print data DP for each pixel constituting the printed image to be formed on the printing sheet p. This produces sequential lines of the printed image on the printing sheet p, to consequently accomplish KCMY multicolor printing.

<Flushing Process>

The flushing process performed in the printing system 100 according to the preferred embodiment of the present invention will be described hereinafter. The flushing process according to this preferred embodiment refers to such a process that, if there will be an inkjet nozzle 24 which ejects ink the amount of which is less than a predetermined reference level as a result of the printing process performed for the print job data DJ by the printing apparatus 2, the inkjet nozzle 24 is forced to eject ink in appropriately timed relation. Performing the flushing process while the printing process for a piece of print job data DJ is being done prevents the drying of the ink near the inkjet nozzle 24. Specifically, the details of the flushing process are roughly divided into the following three processes: a flushing judgment process for judging whether such a forcible ejection is necessary or not; an ejection adjustment process for determining the landing position of ink ejected from an inkjet nozzle 24 to be subjected to the flushing and for adjusting the amount of ejection of the ink; and a flushing ejection process for actually ejecting the ink.

Figure 7:
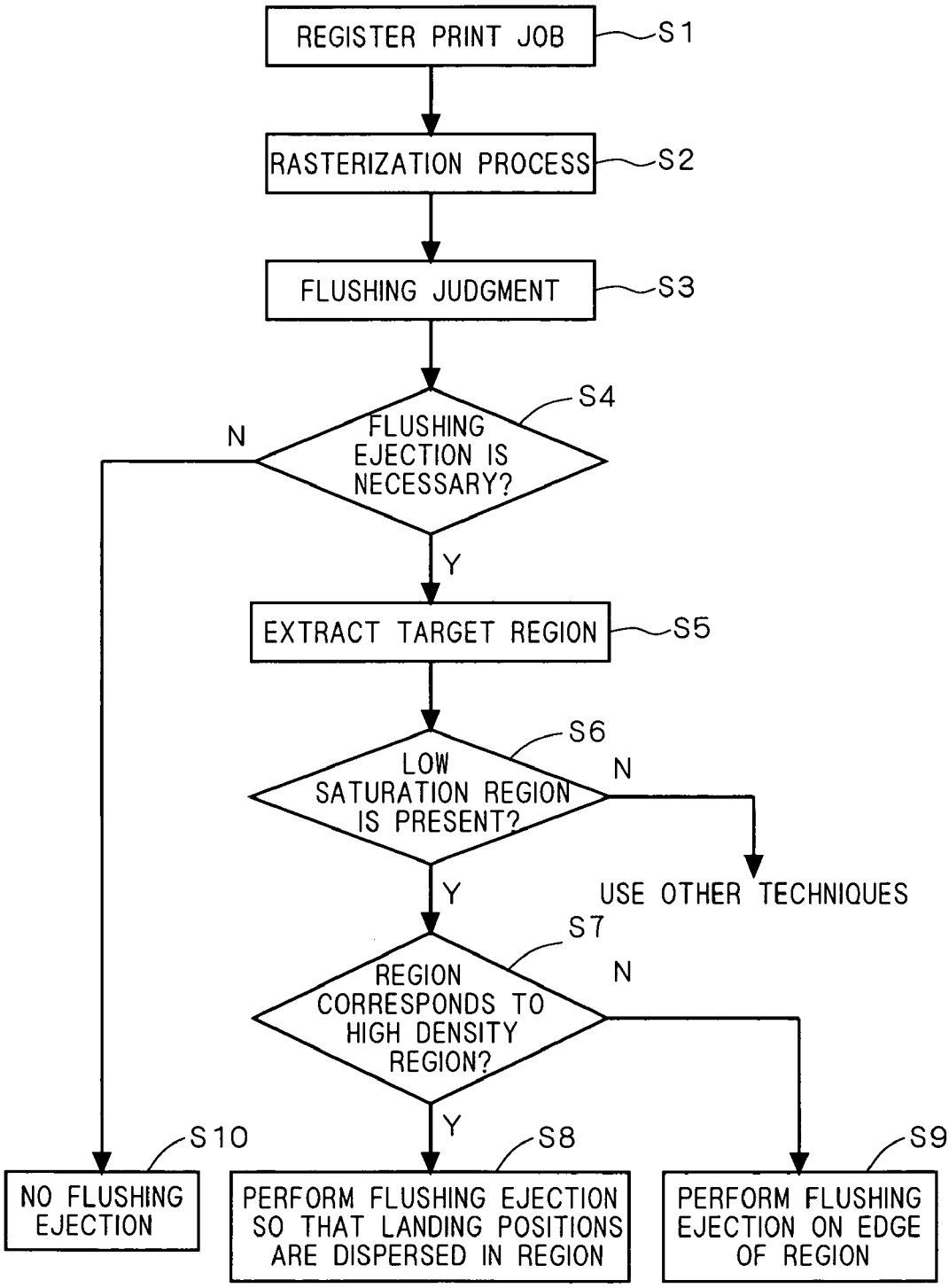
FIG. 7 is a flow diagram showing a variety of processes related to a flushing process and performed in the printing system.
Figure 8:
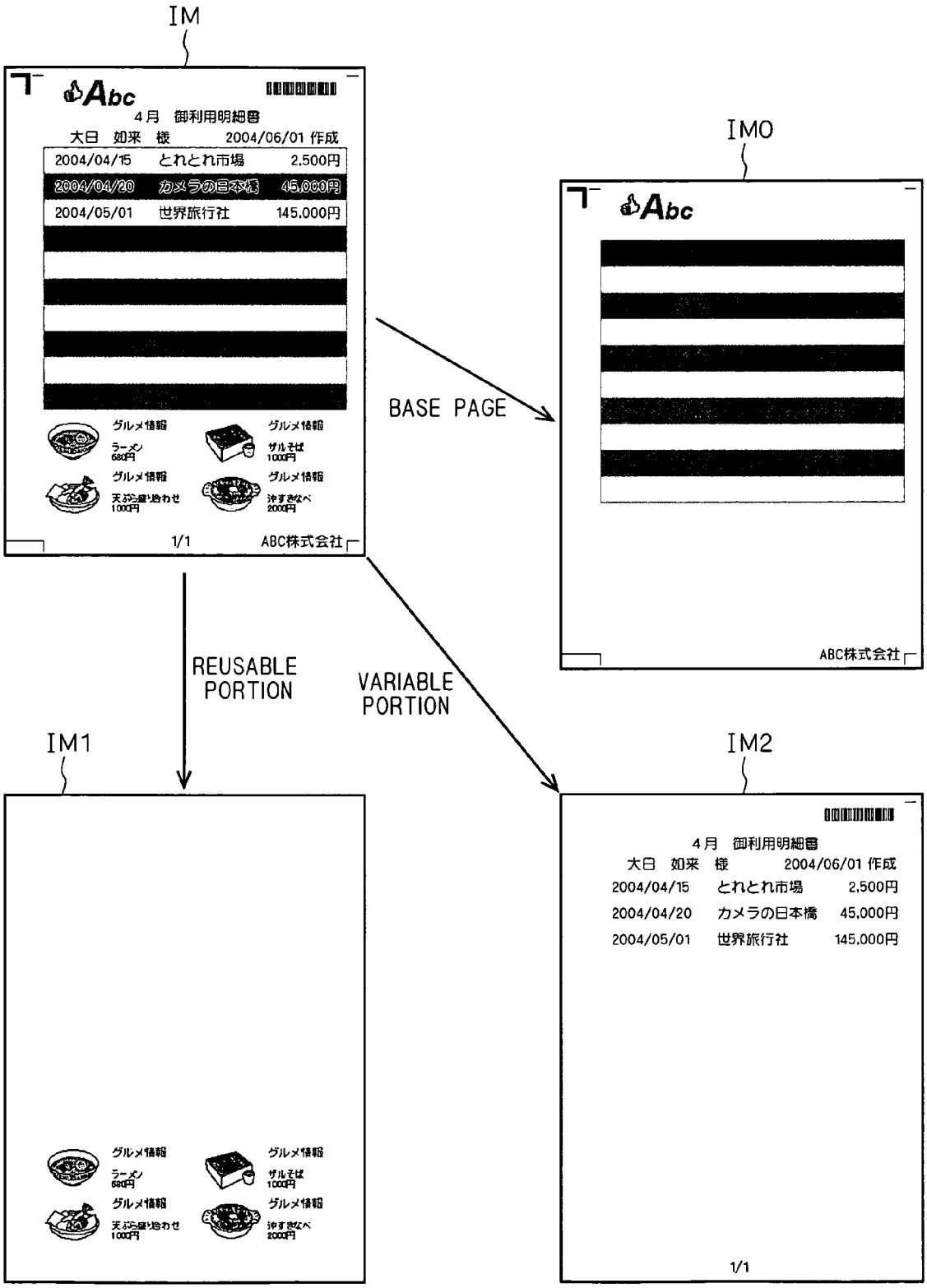
FIG. 8 is a view illustrating a variety of printed images for a printed sheet obtained from a certain piece of print job data.

FIG. 7 is a flow diagram showing a variety of processes related to the flushing process and performed in the printing system 100. FIG. 8 is a view illustrating a printed image (entire image) IM for a printed sheet obtained from a certain piece of print job data DJ, an image (base page image) IM0 of a base page portion thereof, an image (reusable image) IM1 of a reusable portion thereof, and an image (variable image) IM2 of a variable portion thereof. The base page image IM0 is an image obtained based on the base rasterized data DR0. The reusable image IM1 is an image obtained based on a piece of reusable rasterized data DR1. The variable image IM2 is an image obtained based on a piece of variable rasterized data DR2. The following description will be given on the flushing operation for variable printing such that successive changes are made in the reusable portion and the variable portion of the printed image IM shown in FIG. 8 for the production of a plurality of printed sheets.

A piece of print job data DJ generated in the job creation apparatus 1*a* for producing a printed sheet which forms the printed image IM thereon is transferred to the controller 3 and stored in the storage part 32. At the same time, the job acceptance part 31 records information necessary for identifying the piece of print job data DJ on the registered job information RI (in Step S1).

A plurality of pieces of print job data DJ registered in the registered job information RI successively become a target subjected to the printing process in accordance with records in the registered job information RI. In this process, the rasterization process is first performed by the action of the rasterization processing part 33 (in Step S2). This generates the base rasterized data DR0, the reusable rasterized data DR1 and the variable rasterized data DR2. The reusable rasterized data DR1 and the variable rasterized data DR2 are generated from all of the pieces of reusable data DV1 and variable data DV2 that are necessary for a series of variable printing processes.

Then, the flushing judgment part 34 performs the flushing judgment process in accordance with the judgment criterion data DF. Whether the flushing ejection is necessary or not is determined in accordance with the result of the flushing judgment process (in Steps S3 and S4). In this preferred embodiment, the flushing judgment process is performed based on the descriptions of the base rasterized data DR0.

The reason why the flushing judgment is made based on the descriptions of the base rasterized data DR0 is as follows. Because the base rasterized data DR0 is used for the formation of an image on the base page which is a portion common to all printed sheets in the variable printing, only previously making the flushing judgment based on the descriptions of the base rasterized data DR0 enables all of the inkjet nozzles 24 to surely eject ink while at least one printed sheet is being produced, regardless of whether the flushing ejection is necessary or not as a result of the judgment. Additionally, for the execution of the variable printing for a single piece of print job data DJ, only previously making the single flushing judgment once based on the descriptions of a single piece of base rasterized data DR0 eliminates the need to make flushing judgments one by one in corresponding relation to the production of individual printed sheets, thereby improving efficiency. This also means that the increase in the number of printed sheets to be produced does not cause the increase in processing burdens related to the flushing judgment.

Figure 9A:
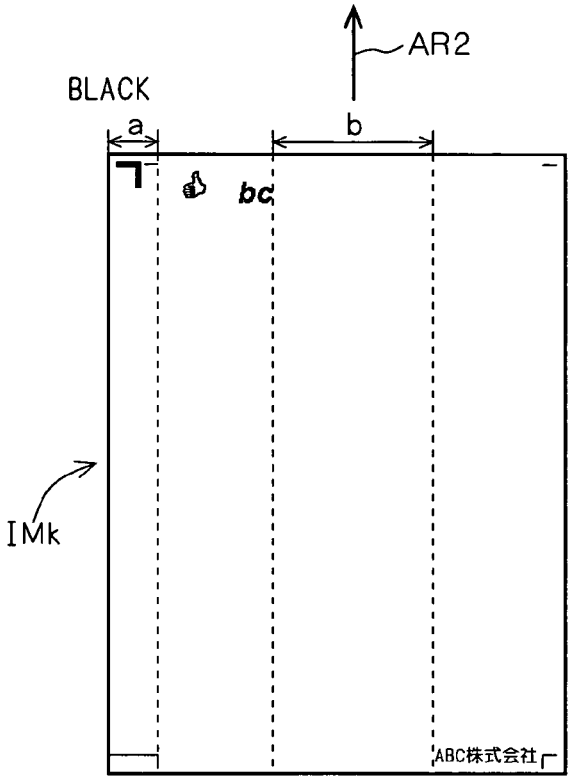
FIGS. 9A through 9D are views showing KCMY images for a base page image for illustration of a flushing judgment process.
Figure 9B:
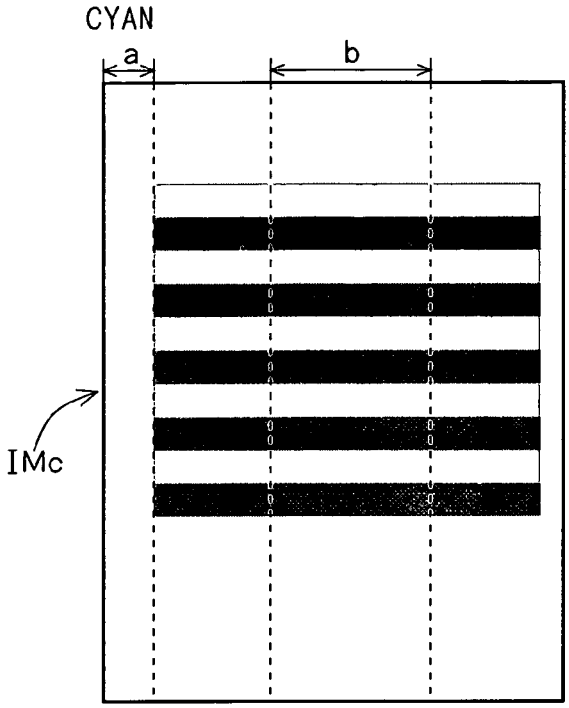
Figure 9C:
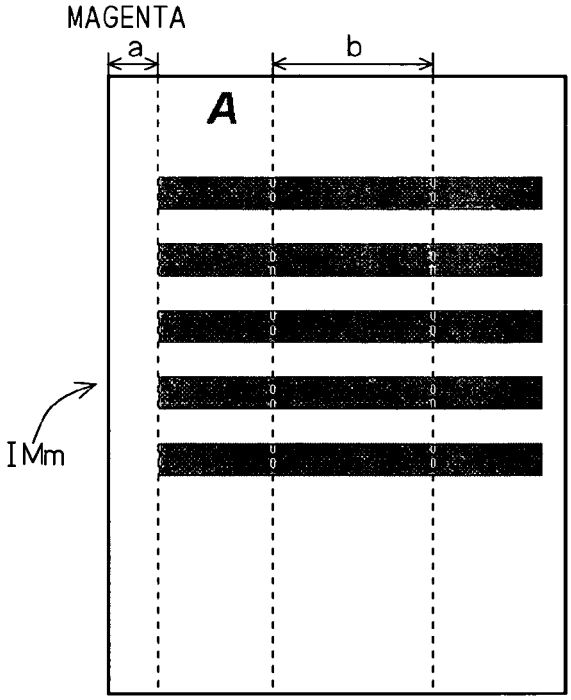
Figure 9D:
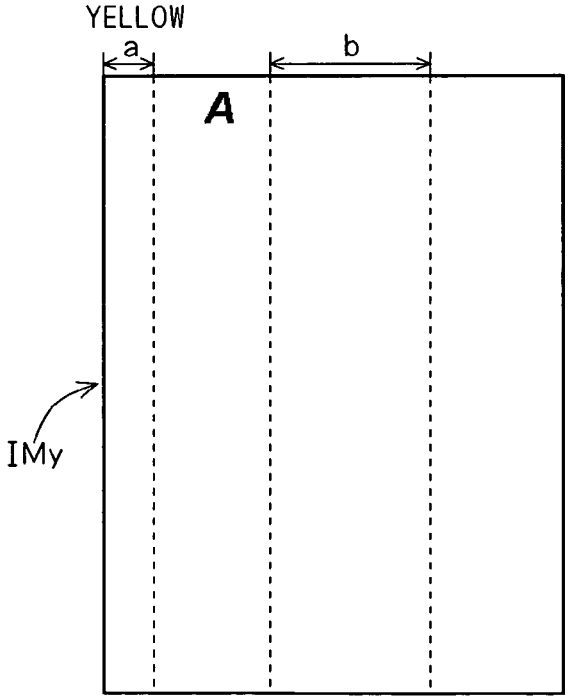

FIGS. 9A through 9D are views showing KCMY images for the base page image IM0 shown in FIG. 8 for the illustration of the flushing judgment process. FIG. 9A shows an image IMk printed in black (K). FIG. 9B shows an image IMc printed in cyan (C). FIG. 9C shows an image IMm printed in magenta (M). FIG. 9D shows an image IMy printed in yellow (Y). In other words, these images are those represented by the image data for the KCMY color components which constitute the base rasterized data DR0, and indicate images to be formed by the ejection parts 2K, 2C, 2M and 2Y for the respective color components when printing is done in the printing apparatus 2. Although indicated in black and white in FIGS. 9A through 9D for convenience of illustration, the images IMc, IMm and IMy are in reality those represented only by C, M and Y color components, respectively.

Printing is done in the printing apparatus 2 by ejecting inks from the ejection parts 2K, 2C, 2M and 2Y onto a printing sheet passing immediately under the fixed inkjet head 2H. It is assumed herein that the images IMk, IMc, IMm and IMy are formed (in reality, an image obtained by superimposing the images IMk, IMc, IMm and IMy on each other is formed) by feeding the printing sheet in a direction indicated by the arrow AR2 of FIG. 9A. In other words, it is assumed that the images for the respective color components are formed by ejecting the inks from the inkjet nozzles 24 arranged in a direction perpendicular to the direction indicated by the arrow AR2 in the plane of FIG. 9A, that is, in the transverse direction of the printed image. In this case, the bounds within which the ink ejected from a single one of the inkjet nozzles 24 can be placed on the printing sheet form a straight line extending in the direction indicated by the arrow AR2 or in a print direction. Thus, in Step S3, the flushing judgment part 34 calculates the sum of the amounts of ink ejected from each of the inkjet nozzles 24 in the direction indicated by the arrow AR2 based on the color density values of the respective pixels described in the base rasterized data DR0. In Step S4, whether the flushing ejection is necessary or not is judged depending on whether the calculated sum of the amounts of ink ejection reaches a reference amount of ejection described in the judgment criterion data DF. It is assumed herein to be described in the judgment criterion data DF that the flushing is necessary when the amount of ink ejection in the printing of a single base page is not more than one pixel. The format in which the judgment criterion data DF is described is not particularly limited if information necessary for the flushing judgment is obtainable from the judgment criterion data DF.

Whether the flushing ejection is necessary or not for the images shown in FIGS. 9A through 9D will be specifically considered. There is a layout element (specifically, a register mark and the like), for example, in a section a of the image IMk for black. However, the section a of the images IMc, IMm and IMy for the remaining CMY color components is blank. It is judged to be necessary to eject ink from inkjet nozzles 24 positioned so as to apply ink to the section a among the inkjet nozzles 24 included in the nozzle groups 24C, 24M and 24Y. A section b of the image IMk is blank, whereas there are layout elements in the section b of the images IMc, IMm and IMy. It is hence judged to be necessary to eject ink from inkjet nozzles 24 positioned so as to apply ink to the section b among the inkjet nozzles 24 included in the nozzle group 24K. Similarly, each nozzle group includes inkjet nozzles 24 from which it is judged to be necessary to eject ink for the flushing ejection. An inkjet nozzle 24 from which it is judged to be necessary to eject ink for the flushing ejection is particularly referred to hereinafter as a "flushing-needed nozzle."

When such a flushing-needed nozzle is present (YES in Step S4), a region (target region) which is a candidate for the landing positions to which ink is to be applied during the flushing ejection is extracted by the action of the ejection adjustment processing part 35 (in Step S5). The extraction of the target region is carried out by referencing the descriptions of the adjustment standard data DS, based on color density values obtained without the flushing ejection for all of the pixels positioned within the bounds of locations in which the flushing ejection by flushing-needed nozzles might be performed. The color density values are acquired from the base rasterized data DR0.

The target region is extracted, for example, as a set of pixels each having a color saturation evaluation value V1 exceeding a predetermined threshold value described in the adjustment standard data DS, the color saturation evaluation value V1 being obtained from $$V1=\mathrm{Min}(Vc, Vm, Vy)+Vk \quad (1)$$

where Vk, Vc, Vm and Vy are color density values of KCMY color components, respectively, for a pixel, and Min (a, b, c) is an operator for determining the minimum value of the following values: a, b and c. Alternatively, the target region is extracted additionally as a set of pixels each having a density evaluation value V2 similarly exceeding a predetermined threshold value, the density evaluation value V2 being obtained from $$V2=((Vc+Vm+Vy)/3+Vk)/2 \quad (2)$$

A region obtained as a set of pixels each having the color saturation evaluation value V1 exceeding its threshold value is referred to as a low saturation region. A region obtained as a set of pixels each having the density evaluation value V2 exceeding its threshold value is referred to as a high density region.

This extraction of the target region means the execution of the flushing ejection in the low saturation region and additionally in the high density region. In the low saturation region and the high density region, it is relatively difficult to detect a change in hue with the naked eye. Thus, if the color density value of a pixel to be formed in part of the low saturation region or the high density region by the execution of the flushing ejection deviates more or less from a color density value originally intended during the generation of the print job data, the deviation is less conspicuous so that the print quality does not substantially degrade as the flushing ejection is executed. Therefore, the low saturation region and the high density region can be said to be preferred as the target region for the flushing ejection. In particular, this effect is pronounced when the target region is both low in color saturation and high in density.

When a region regarded as both the low saturation region and the high density region is present as a result of the calculations using Equations (1) and (2) (YES in Step S6 and YES in Step S7), the landing positions are determined so that the flushing ejection is carried out, with the landing positions in the above-mentioned region dispersed as randomly as possible (in Step S8). This is achieved, for example, by using a known error diffusion method. The determination of the landing positions may be independently made for each of the flushing-needed nozzles or may be made in consideration for a relative positional relationship between the landing positions for adjacent flushing-needed nozzles. It is, however, necessary that the landing positions are determined so that at least a predetermined amount of ink is ejected from each of the flushing-needed nozzles. Such a predetermined amount of ink to be ejected is previously described in the adjustment standard data DS.

Figure 10A:
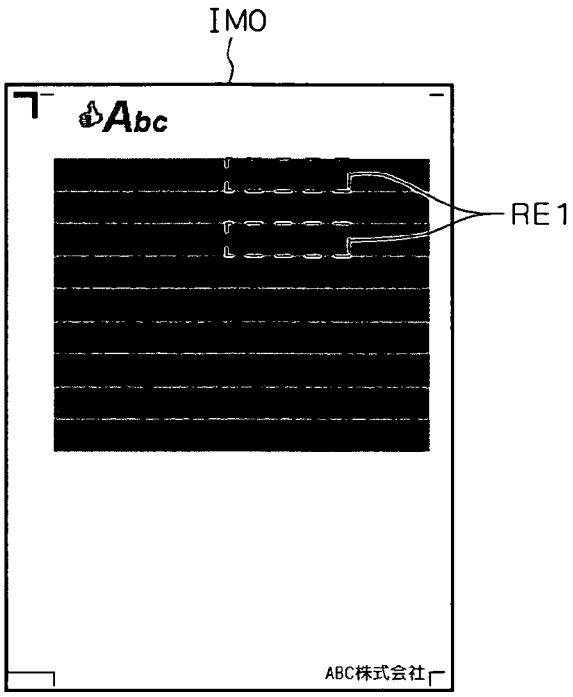
FIGS. 10A, 10B, 11A and 11B are views illustrating the landing positions obtained by flushing ejection.
Figure 10B:
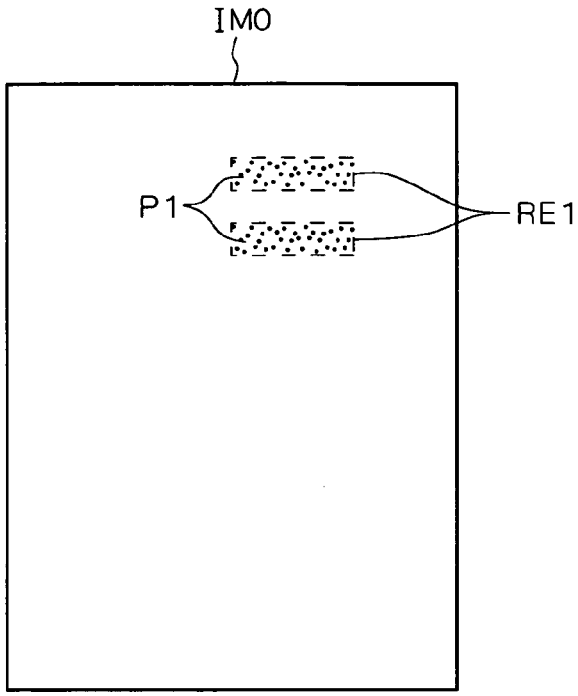

It is assumed that the target region for the flushing ejection from flushing-needed nozzles which apply ink to the section b shown in FIGS. 9A through 9D (or some of the inkjet nozzles 24 included in the nozzle group 24K which apply ink to the section b) is a low saturation and high density region indicated as a region RE1 in the base page image IM0 shown again in FIG. 10A. Then, landing positions P1 randomly dispersed as illustrated in FIG. 10B (although the base page image IM0 is not shown except an outer frame thereof) are determined in the region RE1. Information which specifies the landing positions P1 thus determined is described in the adjustment data DA.

The amount of ink ejected in each of the landing positions P1 is determined so that a hue (referred to as an original hue) represented by the color density value in the base page image IM0 which is to be originally printed in the region RE1 is held almost intact after the flushing ejection. In other words, the color density value in each of the landing positions P1 after the flushing ejection is set so that the hue in each of the landing positions P1 after the flushing ejection is approximately the same as the original hue, and the amount of ink ejection is determined in accordance with the above-mentioned color density value. To this end, changes are appropriately made to not only the amount of ejection of the ink of a color component being subjected to the flushing ejection but also the amounts of ejection of the inks of the remaining color components to be ejected in each of the landing positions P1. An example of this process is such that when the color density values of the original hue in the region RE1 are set at (K, C, M, Y)=(0, 11, 18, 0) (in percent), the amounts of ejection of the inks are determined to provide the color density values of (K, C, M, Y)=(2, 10, 17, 0).

In this case, the flushing ejection for black is performed so that the color density value which has been originally 0% is changed to 2%, and the flushing ejection for cyan and magenta is performed so that the color density value is decreased by 1% from the original color density value. The color density values after the changes are described in the adjustment data DA in association with the information specifying the above-mentioned landing positions P1. Alternatively, information about a difference between the color density value representing the original hue and the color density value for use in the flushing ejection may be described in the adjustment data DA.

The above-mentioned increase and decrease in color density value are only illustrative. Actually, the increase and decrease may be on the order of sub-percent. The number of times of ejection from a single flushing-needed nozzle and the amount of ink to be ejected at a time are not particularly limited if the original purpose of the flushing ejection, such as the prevention of variations in ink viscosity, is accomplished and the above-mentioned approximation of the hue is achieved.

On the other hand, when a region regarded as the low saturation region but not regarded as the high density region is present as a result of the calculations using Equations (1) and (2) (YES in Step S6 and NO in Step S7), an edge portion of the above-mentioned region is determined as the landing positions for the flushing ejection (in Step S9).

Figure 11A:
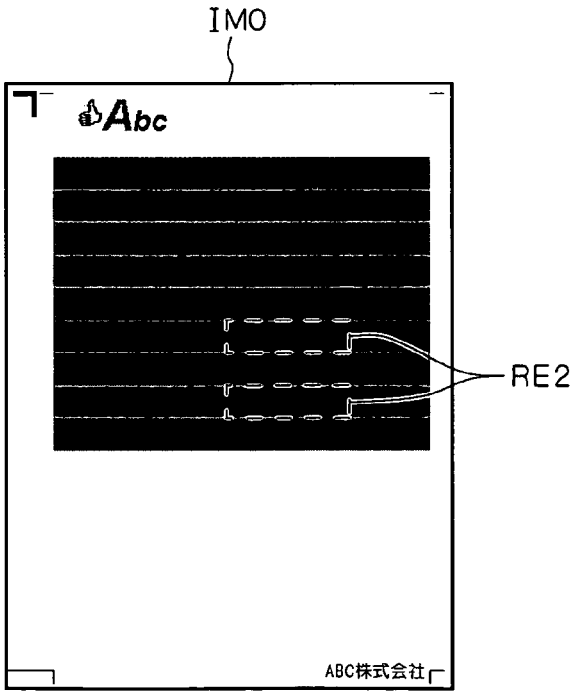
Figure 11B:
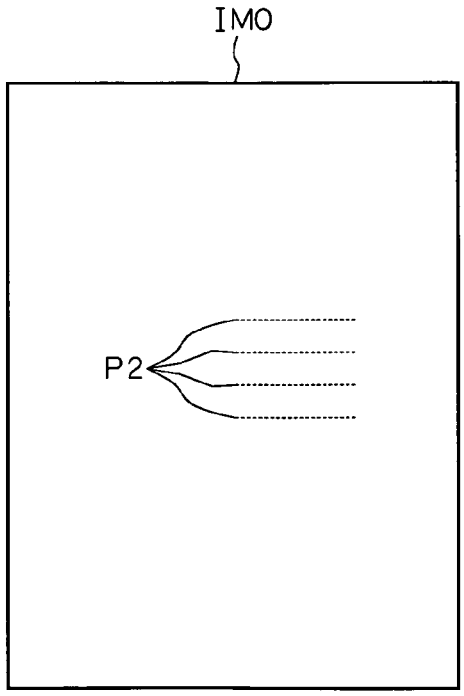

It is assumed that the target region for the flushing ejection from flushing-needed nozzles which apply ink to the above-mentioned section b shown in FIGS. 9A through 9D is a region low in color saturation but not high in density which is indicated as a region RE2 in the base page image IM0 shown again in FIG. 11A. Then, landing positions P2 are determined in the edge portion of the region RE2, as illustrated in FIG. 11B. Information which specifies the landing positions P2 thus determined is described in the adjustment data DA.

The amount of ink ejected in each of the landing positions P2 is determined so that the original hue in the edge portion is held almost intact after the flushing ejection. In other words, the color density value in each of the landing positions P2 after the flushing ejection is set so that the hue in each of the landing positions P2 after the flushing ejection is approximately the same as the original hue, and the amount of ink ejection is determined in accordance with the above-mentioned color density value. To this end, changes are appropriately made to not only the amount of ejection of the ink of a color component being subjected to the flushing ejection but also the amounts of ejection of the inks of the remaining color components to be ejected in each of the landing positions P2, as in the case of the determination of the color density value in the above-mentioned landing positions P1.

Information about the color density value after the changes or a difference from the color density value representing the original hue is described in the adjustment data DA in association with the information specifying the above-mentioned landing positions P2, in a manner similar to the above.

When the low saturation region is absent as a result of the calculations using Equations (1) and (2) (NO in Step S6), there is no region suitable for the flushing process according to this preferred embodiment. Thus, other types of flushing processes or other techniques for preventing the drying of ink in the inkjet nozzles 24 are employed.

When it is not judged that the flushing ejection is necessary as a result of the flushing judgment process (NO in Step S4), all of the inkjet nozzles 24 are always used without the need to perform the flushing ejection in the production of printed sheets. In this case, the adjustment data DA is not generated or is provided as null data to the printing execution instruction part 36.

<Printing Process>

The printing process in the printing apparatus 2 is carried out based on the print data DP generated in the printing execution instruction part 36 of the controller 3. For the variable printing, the printing apparatus 2 references the variable setting data DVS included in the print data DP to sequentially combine the base rasterized data DR0, the reusable rasterized data DR1 and the variable rasterized data DR2 together, thereby producing individual printed sheets. In this process, a flushing-needed nozzle for a certain color component from which it is judged to be necessary to eject ink for the flushing ejection and inkjet nozzles for the remaining color components which have the same landing position as the flushing-needed nozzle carry out the ink ejection in accordance with the descriptions of the adjustment data DA for printing of each sheet.

As described above, when the processes related to Steps S8 and S9 are performed, the ejection adjustment processing part 35 generates the adjustment data DA based on the details of the process related to any one of Steps S8 and S9. In this case, the descriptions of the adjustment data DA are reflected in the print data DP generated by the printing execution instruction part 36. In the printing apparatus 2 which has received the print data DP from the controller 3, the control part 29 controls the operations of the respective components so that the ejection of the inks from the nozzle groups 24K, 24C, 24M and 24Y in the landing positions P1 and P2 reflects the descriptions of the adjustment data DA. This allows the flushing ejection from the flushing-needed nozzle to be performed whenever individual printed sheets are produced by the variable printing. Therefore, the state of the ink ejected from the inkjet nozzles 24 is always held uniform. This provides printed sheets of uniform product quality.

When the flushing ejection is not necessary, all of the inkjet nozzles 24 are used at all times. Therefore, the quality of the individual printed sheets is maintained during the variable printing based on the print data DP.

In the printing system according to this preferred embodiment as described hereinabove, the low saturation region and the high density region in a sheet to be printed are specified by using the rasterized data. In a region which is low in saturation and is high in density, the flushing ejection is performed, with the landing positions dispersed in the region. In a region which is low in saturation but is not high in density, the edge portion is determined as the landing positions. During these processes, the adjustment is additionally made to the ejection from the inkjet nozzles for color components which are not to be subjected to the flushing ejection, to thereby maintain the original hue of the above-mentioned region. This achieves the flushing ejection while minimizing the degradation of the quality of the printed sheets. Further, in the variable printing, whether the flushing ejection is necessary or not is judged based on the details to be printed on the base page. This causes the execution of the flushing ejection whenever the individual printed sheets are produced. Therefore, the print quality is held uniform during the production of a multiplicity of different printed sheets.

<Modifications>

Although the above-mentioned preferred embodiment is premised on the variable printing, the variable printing is not essential according to the present invention. As an example, for printing a plurality of copies of a printed sheet identical in printed details, the flushing judgment may be made based on the rasterized data generated from the layout data about the printed sheet. When it is judged that the flushing ejection is necessary, the flushing ejection may be caused each time a copy of the printed sheet is printed. Such a form of processing is similar to the above-mentioned preferred embodiment in that the printed details contain a repetition and the flushing judgment is made based on the rasterized data about a repeating unit.

In executing the flushing ejection on the low saturation region and the high density region, it is not an essential requirement to make the flushing judgment on such a repeating unit. The process of extracting the above-mentioned target region is similarly applicable when producing a printed sheet having a plurality of pages different in printed details from each other, in which case the flushing judgment is made on the rasterized data about all of the pages and the flushing ejection is performed based on the result of the flushing judgment.

The extraction of the low saturation region and the high density region is based on the result of calculations in Equations (1) and (2) in the above-mentioned preferred embodiments. Instead, the low saturation region and the high density region may be extracted by reference to a predetermined look-up table.

While the invention has been described in detail, the foregoing description is in all aspects illustrative and not restrictive. It is understood that numerous other modifications and variations can be devised without departing from the scope of the invention.

What is claimed is:

1. A printing system comprising:

a) a printing apparatus including a fixed print head having a plurality of nozzles arranged in an array in corresponding relation to each of a plurality of color components, said printing apparatus ejecting ink from said plurality of nozzles based on predetermined printing data described in raster format to perform printing on a printing sheet; and b) a controller for said printing apparatus, said controller including b-1) an acquisition element for acquiring print job data, b-2) a generation element for generating said printing data in accordance with descriptions of said print job data, b-3) a judgment element for judging whether flushing ejection from each of said plurality of nozzles is necessary or not to identify a flushing-needed nozzle among said plurality of nozzles, b-4) a flushing ejection adjustment element for determining landing positions to which said flushing-needed nozzle applies ink during said flushing ejection and for adjusting the amount of ink ejection in said landing positions to generate adjustment data having described therein information about said landing positions and the amount of ink ejection after said adjustment, and b-5) an instruction element for instructing said printing apparatus to perform printing based on said printing data and said adjustment data, said judgment element calculating the amount of ink ejection from each of said plurality of nozzles in the case of executing a printing process for said print job data in said printing apparatus, based on descriptions of said printing data, thereby to judge whether said flushing ejection from each of said plurality of nozzles is necessary or not, based on a result of the calculation, said flushing ejection adjustment element identifying a low saturation region based on said printing data to determine said low saturation region as a target for said landing positions, said low saturation region appearing in a printed sheet when a printing process for said print job data is performed in said printing apparatus, and said flushing ejection adjustment element also adjusting the amount of ink ejection from some of said plurality of nozzles which are other than said flushing-needed nozzle and which have the same landing positions as said flushing-needed nozzle so that a hue in said landing positions is approximately maintained after said flushing ejection when said flushing ejection adjustment element adjusts the amount of ink ejection in said landing positions to which said flushing-needed nozzle applies ink during said flushing ejection.

2. The printing system according to claim 1, wherein said flushing ejection adjustment element identifies a high density region based on said printing data to determine said landing positions so that said landing positions are dispersed in said low saturation region when said low saturation region corresponds to said high density region, said high density region appearing in a printed sheet when a printing process for said print job data is performed in said printing apparatus.

3. The printing system according to claim 2, wherein said flushing ejection adjustment element determines an edge portion of said low saturation region as said landing positions when said low saturation region does not correspond to said high density region.

4. The printing system according to claim 1, wherein:

said generation element is configured to generate data including unit printing data corresponding to repeating unit data for causing repeated printing of the same printed details as said printing data when said print job data includes said repeating unit data;

said judgment element is configured to identify said flushing-needed nozzle based on said unit printing data; and said flushing ejection adjustment element is configured to determine said landing positions to which said flushing-needed nozzle applies ink during said flushing ejection and adjust said amount of ink ejection, based on said unit printing data.

5. The printing system according to claim 4, wherein:

said generation element is configured to generate first printing data representing printed details of a base page common to all printed sheets as said unit printing data, and second printing data representing printing details variable in individual printed sheets, thereby to generate said printing data, when said print job data is data for variable printing;

said judgment element is configured to identify said flushing-needed nozzle based on said first printing data; and said flushing ejection adjustment element is configured to determine said landing positions to which said flushing-needed nozzle applies ink during said flushing ejection and adjust said amount of ink ejection, based on said first printing data.

6. A controller for a printing apparatus, said printing apparatus including a fixed print head having a plurality of nozzles arranged in an array in corresponding relation to each of a plurality of color components, said printing apparatus ejecting ink from said plurality of nozzles based on predetermined printing data described in raster format to perform printing on a printing sheet, said controller comprising:

a) an acquisition element for acquiring print job data;

b) a generation element for generating said printing data in accordance with descriptions of said print job data;

c) a judgment element for judging whether flushing ejection from each of said plurality of nozzles is necessary or not to identify a flushing-needed nozzle among said plurality of nozzles;

d) a flushing ejection adjustment element for determining landing positions to which said flushing-needed nozzle applies ink during said flushing ejection and for adjusting the amount of ink ejection in said landing positions to generate adjustment data having described therein information about said landing positions and the amount of ink ejection after said adjustment; and e) an instruction element for instructing said printing apparatus to perform printing based on said printing data and said adjustment data, said judgment element calculating the amount of ink ejection from each of said plurality of nozzles in the case of executing a printing process for said print job data in said printing apparatus, based on descriptions of said printing data, thereby to judge whether said flushing ejection from each of said plurality of nozzles is necessary or not, based on a result of the calculation, said flushing ejection adjustment element identifying a low saturation region based on said printing data to determine said low saturation region as a target for said landing positions, said low saturation region appearing in a printed sheet when a printing process for said print job data is performed in said printing apparatus, and said flushing ejection adjustment element also adjusting the amount of ink ejection from some of said plurality of nozzles which are other than said flushing-needed nozzle and which have the same landing positions as said flushing-needed nozzle so that a hue in said landing positions is approximately maintained after said flushing ejection when said flushing ejection adjustment element adjusts the amount of ink ejection in said landing positions to which said flushing-needed nozzle applies ink during said flushing ejection.

7. The controller according to claim 6, wherein said flushing ejection adjustment element identifies a high density region based on said printing data to determine said landing positions so that said landing positions are dispersed in said low saturation region when said low saturation region corresponds to said high density region, said high density region appearing in a printed sheet when a printing process for said print job data is performed in said printing apparatus.

8. The controller according to claim 7, wherein said flushing ejection adjustment element determines an edge portion of said low saturation region as said landing positions when said low saturation region does not correspond to said high density region.

9. The controller according to claim 6, wherein:

said generation element is configured to generate data including unit printing data corresponding to repeating unit data for causing repeated printing of the same printed details as said printing data when said print job data includes said repeating unit data;

said judgment element is configured to identify said flushing-needed nozzle based on said unit printing data; and said flushing ejection adjustment element is configured to determine said landing positions to which said flushing-needed nozzle applies ink during said flushing ejection and adjust said amount of ink ejection, based on said unit printing data.

10. The controller according to claim 9, wherein:

said generation element is configured to generate first printing data representing printed details of a base page common to all printed sheets as said unit printing data, and second printing data representing printing details variable in individual printed sheets, thereby to generate said printing data, when said print job data is data for variable printing;

said judgment element is configured to identify said flushing-needed nozzle based on said first printing data; and said flushing ejection adjustment element is configured to determine said landing positions to which said flushing-needed nozzle applies ink during said flushing ejection and adjust said amount of ink ejection, based on said first printing data.

11. A method of executing a printing process in a printing apparatus, said printing apparatus including a fixed print head having a plurality of nozzles arranged in an array in corresponding relation to each of a plurality of color components, said printing apparatus ejecting ink from said plurality of nozzles based on predetermined printing data described in raster format to perform printing on a printing sheet, said method comprising the steps of:

a) acquiring print job data;

b) generating said printing data in accordance with descriptions of said print job data;

c) calculating the amount of ink ejection from each of said plurality of nozzles in the case of executing a printing process for said print job data in said printing apparatus, based on descriptions of said printing data;

d) judging whether flushing ejection from each of said plurality of nozzles is necessary or not to identify a flushing-needed nozzle among said plurality of nozzles;

e) determining landing positions to which said flushing-needed nozzle applies ink during said flushing ejection and adjusting the amount of ink ejection in said landing positions to generate adjustment data having described therein information about said landing positions and the amount of ink ejection after said adjustment; and f) performing printing in said printing apparatus, based on said printing data and said adjustment data, wherein, in said step d), whether said flushing ejection from each of said plurality of nozzles is necessary or not is judged, based on a result of the calculation of said step c), and wherein, in said step e), a low saturation region is identified based on said printing data, and is determined as a target for said landing positions, said low saturation region appearing in a printed sheet when a printing process for said print-job data is performed in said printing apparatus, and wherein, in said step e), the amount of ink ejection from some of said plurality of nozzles which are other than said flushing-needed nozzle and which have the same landing positions as said flushing-needed nozzle is also adjusted so that a hue in said landing positions is approximately maintained after said flushing ejection when the adjustment is made to the amount of ink ejection in said landing positions to which said flushing-needed nozzle applies ink during said flushing ejection.

12. The method according to claim 11, wherein in said step e), a high density region is identified based on said printing data, and said landing positions are determined so that said landing positions are dispersed in said low saturation region when said low saturation region corresponds to said high density region, said high density region appearing in a printed sheet when a printing process for said print job data is performed in said printing apparatus.

13. The method according to claim 12, wherein an edge portion of said low saturation region is determined as said landing positions in said step e) when said low saturation region does not correspond to said high density region.

14. The method according to claim 11, wherein:

in said step b), when said print job data includes repeating unit data for causing repeated printing of the same printed details, data including unit printing data corresponding to said repeating unit data is generated as said printing data;

in said step c), the amount of ink ejection from each of said plurality of nozzles in performing printing for said unit printing data is calculated based on descriptions of said unit printing data; and in said step e), the determination of said landing positions to which said flushing-needed nozzle applies ink during said flushing ejection and the adjustment of said amount of ink ejection are carried out based on said unit printing data.

15. The method according to claim 14, wherein:

in said step b), when said print job data is data for variable printing, first printing data representing printed details of a base page common to all printed sheets is generated as said unit printing data, and second printing data representing printing details variable in individual printed sheets is generated, whereby said printing data is generated;

in said step c), the amount of ink ejection from each of said plurality of nozzles in performing printing of said base page is calculated based on descriptions of said first printing data; and in said step e), the determination of said landing positions to which said flushing-needed nozzle applies ink during said flushing ejection and the adjustment of said amount of ink ejection are carried out based on said first printing data.

16. A program stored on a computer, said program being executed in said computer thereby to cause said computer to function as a controller for a printing apparatus, said printing apparatus including a fixed print head having a plurality of nozzles arranged in an array in corresponding relation to each of a plurality of color components, said printing apparatus ejecting ink from said plurality of nozzles based on predetermined printing data described in raster format to perform printing on a printing sheet, said controller comprising:

a) an acquisition element for acquiring print job data;

b) a generation element for generating said printing data in accordance with descriptions of said print job data;

c) ajudgment element for judging whether flushing ejection from each of said plurality of nozzles is necessary or not to identify a flushing-needed nozzle among said plurality of nozzles;

d) a flushing ejection adjustment element for determining landing positions to which said flushing-needed nozzle applies ink during said flushing ejection and for adjusting the amount of ink ejection in said landing positions to generate adjustment data having described therein information about said landing positions and the amount of ink ejection after said adjustment; and e) an instruction element for instructing said printing apparatus to perform printing based on said printing data and said adjustment data, said judgment element calculating the amount of ink ejection from each of said plurality of nozzles in the case of executing a printing process for said print job data in said printing apparatus, based on descriptions of said printing data, thereby to judge whether said flushing ejection from each of said plurality of nozzles is necessary or not, based on a result of the calculation, said flushing ejection adjustment element identifying a low saturation region based on said printing data to determine said low saturation region as a target for said landing positions, said low saturation region appearing in a printed sheet when a printing process for said print job data is performed in said printing apparatus, and said flushing ejection adjustment element also adjusting the amount of ink ejection from some of said plurality of nozzles which are other than said flushing-needed nozzle and which have the same landing positions as said flushing-needed nozzle so that a hue in said landing positions is approximately maintained after said flushing ejection when said flushing ejection adjustment element adjusts the amount of ink ejection in said landing positions to which said flushing-needed nozzle applies ink during said flushing ejection.

* * * * *